US008107846B2

(12) United States Patent
Kim

(10) Patent No.: US 8,107,846 B2
(45) Date of Patent: Jan. 31, 2012

(54) IMAGE FORMING APPARATUS AND CONTROL METHOD THEREOF

(75) Inventor: Jin-ha Kim, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 386 days.

(21) Appl. No.: 12/354,857

(22) Filed: Jan. 16, 2009

(65) Prior Publication Data

US 2009/0220270 A1 Sep. 3, 2009

(30) Foreign Application Priority Data

Mar. 3, 2008 (KR) ..... 10-2008-0019843
May 8, 2008 (KR) ..... 10-2008-0042809

(51) Int. Cl.
*G03G 15/00* (2006.01)

(52) U.S. Cl. ..... 399/88; 399/70

(58) Field of Classification Search ..... 399/69, 399/70, 88–90
See application file for complete search history.

(56) References Cited

U.S. PATENT DOCUMENTS

2005/0169659 A1* 8/2005 Koyama et al. ..... 399/88
* cited by examiner

*Primary Examiner* — Hoang Ngo
(74) *Attorney, Agent, or Firm* — Stanzione & Kim, LLP

(57) ABSTRACT

An image forming apparatus having a normal mode and a standby mode includes an image forming unit to form an image, a switching unit which selectively allows power to be supplied to the image forming unit, a controller to control the switching unit based on a phase signal of the power, a power cut-off unit which cuts off the power to the image forming unit in the standby mode, and a phase detector which is connected to both ends of the power cut-off unit, detects a phase of the power via different phase detection routes according to whether being in the normal mode or in the standby mode, and outputs the phase signal of the power so that a power consumption of the image forming apparatus does not exceed a predetermined value in the standby mode.

39 Claims, 8 Drawing Sheets

IMAGE FORMING APPARATUS AND CONTROL METHOD THEREOF

CROSS-REFERENCE TO RELATED APPLICATIONS

This application claims priority from Korean Patent Applications No. 10-2008-0019843 filed on Mar. 3, 2008 and No. 10-2008-0042809, filed on May 8, 2008 in the Korean Intellectual Property Office, the disclosures of which are incorporated herein in their entirety by reference.

BACKGROUND OF THE INVENTION

1. Field of the Invention

The present general inventive concept relates to an image forming apparatus and a control method thereof, and more particularly, to an image forming apparatus and a control method thereof, in which a phase of an alternating current (AC) power is detected to perform a fusing control.

2. Description of the Related Art

An image forming apparatus, such as a printer, a multifunction peripheral, etc., forms an image on a recording medium, such as paper or the like, etc., based on image data such as a document, a photograph, etc. In a case of an electrophotographic type image forming apparatus such as a laser printer, a toner which is developed on a photoconductive drum is transferred to and fused on a recording medium, to thereby form an image. In this case, the image forming apparatus includes a fusing unit to fuse the toner at a high temperature.

FIG. 1 shows a schematic diagram of a configuration of a conventional image forming apparatus 1. The image forming apparatus 1 includes an image forming unit 11 to form an image, and the image forming unit 11 includes a fusing unit 11*a* which is provided with a heater (not illustrated) for fusing. The image forming apparatus 1 further includes a power supply 12 to supply electric power to the fusing unit 11*a*, and the power supply 12 includes a triac 12*a* to perform a switching operation in order to control a temperature of the fusing unit 11*a*. Also, the image forming apparatus 1 further includes a controller 13 to control the switching operation of the triac 12*a*. The controller 13 controls the triac 12*a* based on a phase of an alternating current (AC) power which is supplied from the power supply 12, and thus the image forming apparatus 1 includes a phase detector 14 to detect the phase of the AC power.

Further, the power supply 12 includes a relay 12*b* to cut off the power supplied to the fusing unit 11*a*, thereby minimizing a power consumption of the triac 12*a* in a standby mode which the image forming apparatus 1 enters when not being used.

FIG. 2 illustrates a relay 12*b* and a phase detector 14 in a conventional image forming apparatus 1. As illustrated in FIG. 2, the relay 12*b* is provided on a power supplying path between an AC power source and the fusing unit 11*a*, and turns on/off based on a relay control signal. If the image forming apparatus 1 operates normally, the relay 12*b* is turned on so that the AC power can be supplied from the power supply 12 to the fusing unit 11*a*. However, if the image forming apparatus 1 enters the standby mode, the relay 12*b* is turned off so that the AC power cannot be supplied from the power supply 12 to the fusing unit 11*a*.

However, in the conventional image forming apparatus 1, since the phase detector 14 is placed downstream of the relay 12*b*, the phase detector 14 cannot properly detect the phase of the AC power when the relay 12*b* is turned off and the AC power is not supplied to the fusing unit 11*a* and the phase detector 14. Particularly, in the standby mode, the conventional image forming apparatus 1 is required to monitor whether the AC power is supplied or not and perform a data backup, a system reset (i.e., a central processing unit (CPU) reboot) or the like operation if the AC power is cut off, but it cannot do that since the relay 12*b* is turned off.

To solve this problem, the phase detector 14 is placed upstream of the relay 12*b* opposite to the one end, such that it is possible to detect the phase of the AC power, however there is still a problem of satisfying a constraint that power which is consumed in the standby mode should not exceed a predetermined electric power (e.g., 1 W). Conventionally, the phase detector 14 includes a plurality of diodes and resistors, therefore it is difficult for this configuration to satisfy a desired constraint on power consumption.

Nonetheless, precise phase control is continuously needed in a normal mode as well as during the standby mode, and thus an image forming apparatus 1 which meets such a need is desired.

SUMMARY OF THE INVENTION

Accordingly, the present general inventive concept provides an image forming apparatus capable of correctly detecting a phase of power in a standby mode and in a normal mode and satisfies a constraint on power consumption requirement, and a control method thereof.

Additional aspects and/or utilities of the present general inventive concept will be set forth in part in the description which follows and, in part, will be obvious from the description, or may be learned by practice of the general inventive concept.

Another aspect of the present general inventive concept is to provide an image forming apparatus capable of performing precise phase control in a normal mode and in a standby mode, and a control method thereof.

The foregoing and/or other aspects and utilities of the present general inventive concept may be achieved by providing an image forming apparatus having a normal mode and a standby mode which includes an image forming unit to form an image, a switching unit to selectively allow power to be supplied to the image forming unit, a controller to control the switching unit based on a phase signal of the power, a power cut-off unit to cut off the power to the image forming unit in the standby mode, and a phase detector which is connected to both ends of the power cut-off unit, to detect a phase of the power via different phase detection routes according to whether being in the normal mode or in the standby mode, and to output the phase signal of the power so that a power consumption of the image forming apparatus does not exceed a predetermined value in the standby mode.

The phase detector may include a first resistor unit connected to a first end of the power cut-off unit to form a first phase detection route in the standby mode, a second resistor unit connected to an end opposite to the first end of the power cut-off unit as connected in parallel with the first resistor unit to form a second phase detection route in the normal mode, and a current-phase converter to output the phase signal of the power corresponding to a current of one of the first phase detection route and the second phase detection route.

A resistance of the first resistor unit may be set so that the image forming apparatus consumes a power of about 1 W or less in the standby mode.

A parallel resistance of the first and second resistor units may be set so that the phase signal of the power has a pulse width of about 1 msec or less in the normal mode.

The current-phase converter may include a photocoupler, and the photocoupler may include a light emitting unit connected in series with the first and second resistor units and a light receiving unit to output the phase signal of the power based on light emitted from the light emitting unit.

The controller monitors whether the power may be supplied or not based on the phase signal of the power in the standby mode.

The controller may perform at least one operation between a data backup and a system reset if the power is cut off.

The foregoing and/or other aspects and utilities of the present general inventive concept may be achieved by providing an image forming apparatus having a normal mode and a standby mode which includes an image forming unit to form an image, a switching unit to selectively supply power to the image forming unit, a controller to control the switching unit based on a phase signal of the power, a power cut-off unit to cut off the power to the image forming unit in the standby mode, and a phase detector to detect a phase of the power and to output a phase signal of the power so that a pulse width of the phase signal is not larger than a first reference value in the normal mode and a power consumption of the image forming apparatus does not exceed a second reference value in the standby mode.

The phase detector may include a first resistor unit connected to a first end of the power cut-off unit, a second resistor unit connected to an end opposite to the first end of the power cut-off unit as connected in parallel with the first resistor unit, and a current-phase converter to output the phase signal of the power, which has a pulse width corresponding to an intensity of a current flowing in the first and second resistor units, to the controller.

A resistance of the first resistor unit may be set so that the second reference value be about 1 W in the standby mode.

A parallel resistance of the first and second resistor units may be set so that the first reference value be about 1 msec in the normal mode.

The current-phase converter may include a photocoupler, and the photocoupler includes a light emitting unit connected in series with the first and second resistor units, and a light receiving unit to output the phase signal of the power based on light emitted from the light emitting unit.

The controller monitors whether the power may be supplied or not based on the phase signal of the power in the standby mode.

The controller may perform at least one operation between a data backup and a system reset if the power is cut off.

The foregoing and/or other aspects and utilities of the present general inventive concept may be achieved by providing a method of controlling an image forming apparatus having a normal mode and a standby mode the method includes outputting a pulse signal of the power by detecting a phase of power supplied to the image forming apparatus so that a pulse width of a phase signal is not larger than a first reference value in the normal mode and a power consumption of the image forming apparatus does not exceed a second reference value in the standby mode, supplying the power by performing a switching operation based on the phase signal of the power in the normal mode, and cutting off the power by stopping the switching operation in the standby mode.

The outputting the phase signal of the power may include detecting the phase of the power via different phase detection routes according to whether being in the normal mode or in the standby mode.

The first reference value may be about 1 msec.

The second reference value may be about 1 W.

The method may further include monitoring whether the power is supplied or not based on the phase signal of the power in the standby mode.

The method may further include performing at least one operation between a data backup and a system reset if the power is cut off.

The foregoing and/or other aspects and utilities of the present general inventive concept may be achieved by providing an image forming apparatus which includes a controller to detect a phase signal of a main power supplied from a power supply and to control a first and second power, which respectively correspond to a first and second mode of the image forming apparatus, supplied to the image forming apparatus based on the phase signal of the main power, the controller detects the phase signal of the main power through a first path during the first mode and a second path during the second mode.

The image forming apparatus may further include a cut-off unit disposed between the power supply and an image forming unit.

The first path may be defined from a point between the power supply and the cut-off unit to the controller.

The second path may be defined from a point between the cut-off unit and the image forming unit to the controller.

The first mode may be a standby mode and the second mode may be a normal mode.

The first power may be less than the second power.

The foregoing and/or other aspects and utilities of the present general inventive concept may be achieved by providing an image forming apparatus which includes an image forming unit, a power source, a relay disposed between the power source and the image forming unit, and a phase detector having two terminals coupled to opposite ends of the relay and another terminal coupled between the power source and the image forming unit to detect a phase to control supply of power of the power source to the image forming unit.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1:
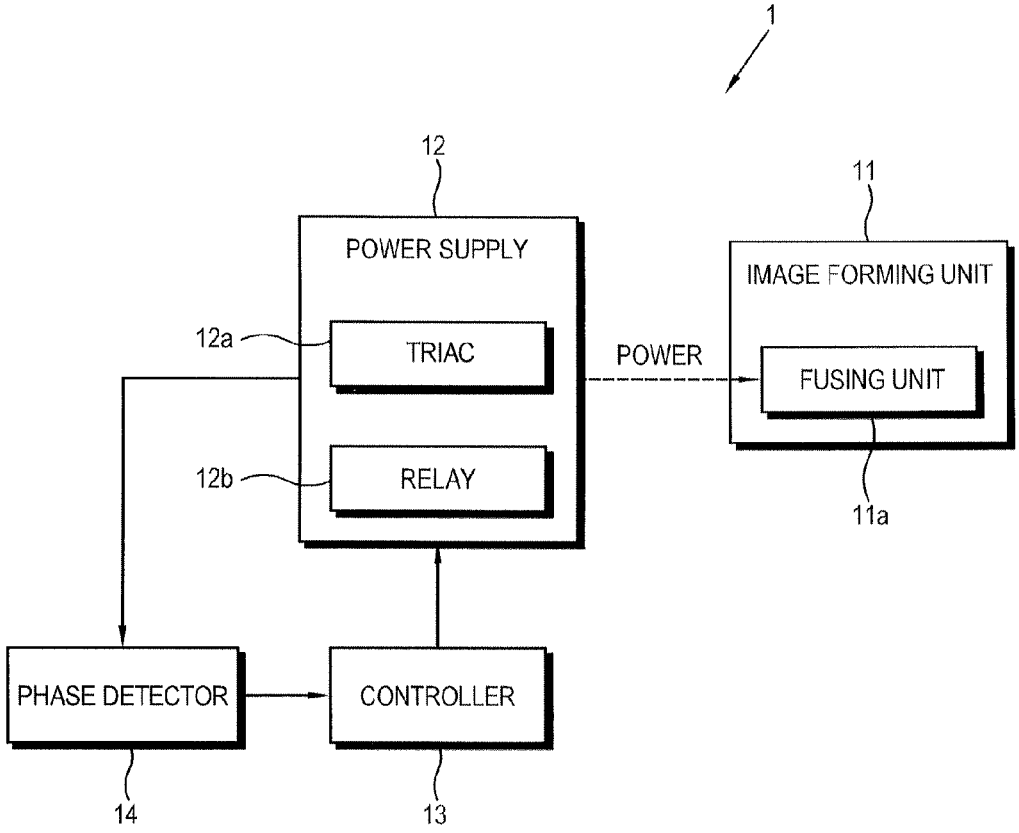
FIG. 1 (RELATED ART)
FIG. 1 illustrates a schematic configuration of an image forming apparatus related to the present general inventive concept.

Exemplary embodiments of the present general inventive concept will be now described in detail with reference to accompanying drawings, and like reference numerals refer to like elements throughout. According to an exemplary embodiment of the present general inventive concept, an image forming apparatus may be achieved by a printer, a multifunction peripheral, etc. which forms an image corresponding to image data such as a document, a photograph, etc. on paper or the like recording medium. Further, according to an exemplary embodiment of the present general inventive concept, the image forming apparatus may form an image in a electrophotographic manner, like a laser printer. However, the present general inventive concept is not limited thereto.

The image forming apparatus according to an exemplary embodiment of the present general inventive concept includes an image forming unit to form an image, a power supply to supply power to the image forming unit, a controller to control the power supply, and a phase detector to detect a phase of the power supply. If not specifically described below, the image forming unit, the power supply, the controller and the phase detector in this exemplary embodiment are the same as or substantially similar to the image forming unit 11, the power supply 12, the controller 13 and the phase detector 14 of the image forming apparatus 1 of FIG. 1, respectively.

Figure 2:
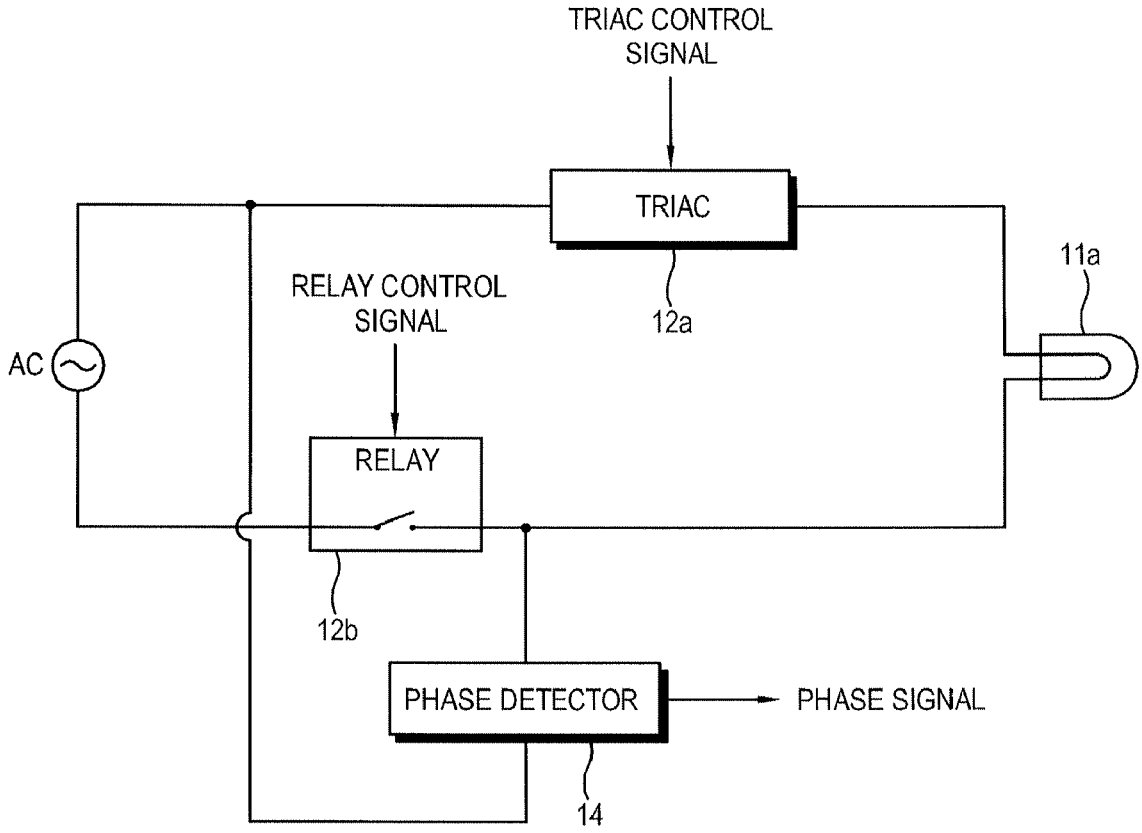
FIG. 2 (RELATED ART)
FIG. 2 illustrates a schematic configuration of a phase detector in a conventional image forming apparatus.
Figure 3:
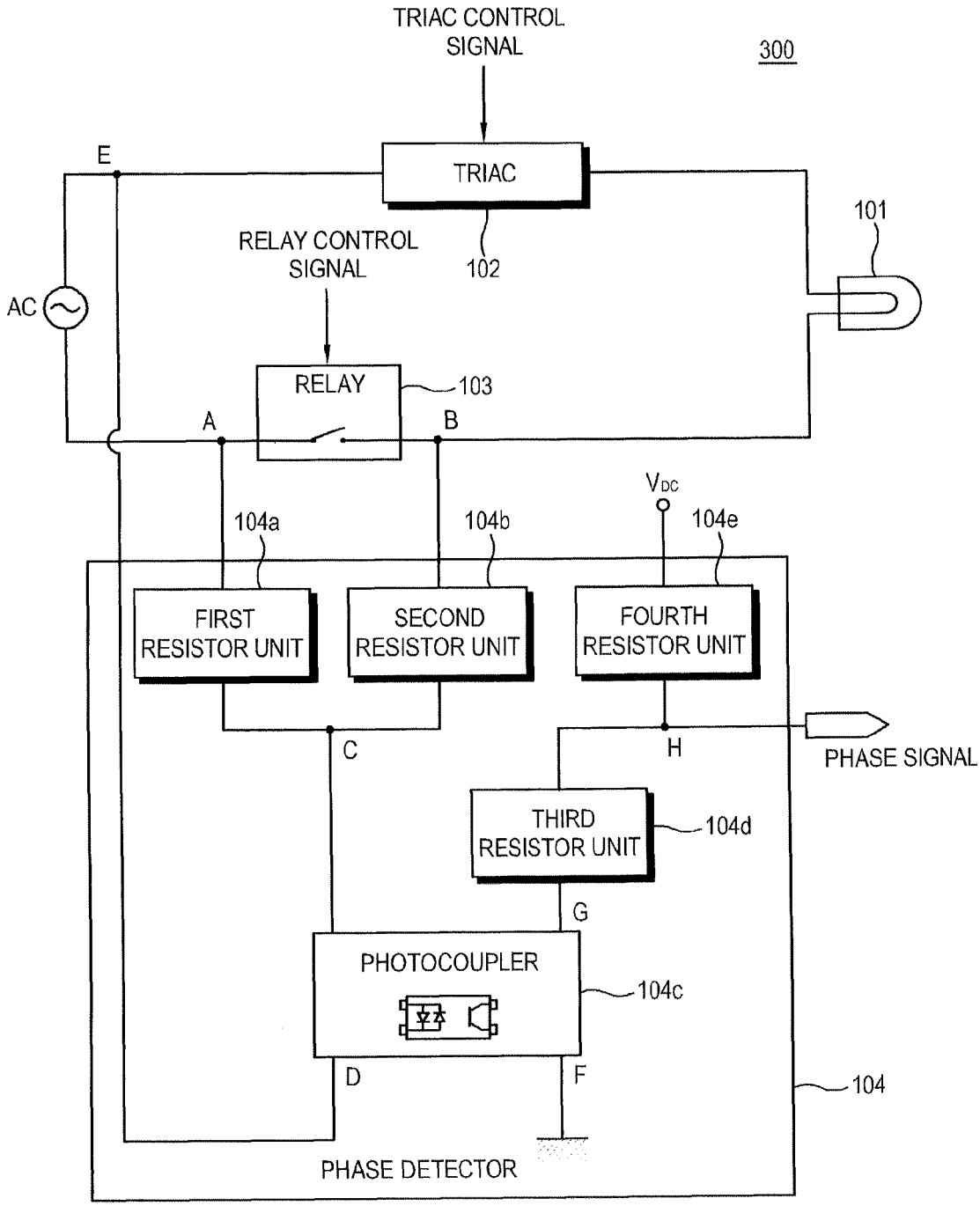
FIG. 3 illustrates a schematic configuration of an image forming apparatus according to an exemplary embodiment of the present general inventive concept.

FIG. 3 illustrates a fusing unit 101, a triac 102, a relay 103 and a phase detector 104 of an image forming apparatus 300 according to an exemplary embodiment of the present general inventive concept. The fusing unit 101, the triac 102 and the relay 103 of the image forming apparatus 300 according to an exemplary embodiment of the present general inventive concept may be the same as or substantially similar to the fusing unit 11*a*, the triac 12*a* and the relay 12*b* of the image forming apparatus 1 illustrated in FIGS. 1 and 2, respectively. The triac 102 and the relay 103 are examples of a switching unit and a power cut-off unit according to an exemplary embodiment of the present general inventive concept. The image forming apparatus 300 may include a feeding unit to feed a printing medium, an image forming unit including the fusing unit 101 to form an image on the printing medium, and a power controller as illustrated in FIG. 3

As illustrated in FIG. 3, the phase detector 104 includes a first resistor unit 104*a*, a second resistor unit 104*b*, a photocoupler 104*c*, a third resistor unit 104*d*, and a fourth resistor unit 104*e*. The photocoupler 104*c* is an example of a current-phase converter according to an exemplary embodiment of the present general inventive concept.

In exemplary embodiments, the first resistor 104*a* may include at least one resistor, and has one end connected to a first end A of the relay 103, for example, between a power source AC and the first end of the relay 103. The second resistor 104*b* may include at least one resistor, and has one end connected to a second end B of the relay 103. Both opposite ends of the first and second resistors 104*a* and 104*b* are connected to a first end C of a light emitting unit of the photocoupler 104*c*.

In the present exemplary embodiment, the resistance of the first resistor unit 104*a* is set such that power consumed by the image forming apparatus 1 in a first mode, such as a standby mode, does not exceed a predetermined value. In an exemplary embodiment, the power consumed by the image forming apparatus in the standby mode may not be more than about 1 W. Here, the first resistor unit 104*a* may have a resistance of about 600 KΩ. However, the present general inventive concept is not limited thereto.

Meanwhile, the resistance of the second resistor unit 104*b* may be set in consideration of the resistance of the first resistor unit 104*a*. In other words, the parallel resistance of the first resistor unit 104*a* and the second resistor unit 104*b* is set such that a phase signal H of alternating current (AC) power has a pulse width equal to or less than a predetermined value. In the present exemplary embodiment, the predetermined value for the pulse width of the phase signal H in a second mode, such as anormal mode, may be about 1 msec (refer to FIG. 5). However, the present general inventive concept is not limited thereto. That is, in exemplary embodiments, the image forming apparatus 1 may include three or more modes.

In an exemplary embodiment, if the first resistor unit 104*a* has a resistance of about 600K Ω, the second resistor unit 104*b* may have a resistance of about 100K Ω. The first and second resistor units 104*a* and 104*b* may have various configurations of resistors within a range which satisfies a given or desired resistance. In an exemplary embodiment, the first resistor unit 104*a* may include two pairs of parallel resistor groups each having three resistors connected in series, and the second resistor unit 104*b* may also include a resistor group having three resistors connected in series.

The photocoupler 104*c* includes the light emitting unit (not illustrated) to emit light corresponding to a flowing current, and a light receiving unit (not illustrated) to be turned on/off according to an intensity of the light emitted from the light emitting unit. The light emitting unit of the photocoupler 104*c* has a second end D connected to one side of the AC power (refer to E of FIG. 3). The light receiving unit of the photocoupler 104*c* has a first end F connected to a ground, and a second end G connected to the third resistor unit 104*d*. However, the present general inventive concept is not limited thereto.

In exemplary embodiments, the third resistor unit 104*d* and the fourth resistor unit 104*e* each include at least one resistor and are connected in series. The fourth resistor unit 104*e* has one end connected to a direct current (DC) power source Vdc. A junction H between the third and fourth resistor units 104*d* and 104*e* serves as an output terminal for the phase signal. In the present exemplary embodiment, the third resistor unit 104*d* and the fourth resistor unit 104*e* may be about 330Ω and about 33 kΩ, respectively. However, the present general inventive concept is not limited thereto.

Below, operations of the phase detector 104 according to an exemplary embodiment of the present general inventive concept will be described in more detail. The first resistor unit 104*a* forms a first phase detection route A~C, and the second resistor unit 104*b* forms a second phase detection route B~C. First, if the relay 103 is in a closed state and the image forming apparatus is in the second mode, which may be a normal mode, the first resistor unit 104*a* and the second resistor unit 104*b* are connected in parallel. In this case, most of the current flows toward the light emitting unit of the photocoupler 104*c* via the second resistor unit 104*b*, since the second resistor 104*b* may have a relatively lower resistance (i.e., the second phase detection route) than that of the first resistor unit 104*a*.

In alternative exemplary embodiments, if the image forming apparatus 1 enters the standby mode and the relay 103 becomes open, there is no current flowing through the relay 103. Thus, the current flows toward the light emitting unit of the photocoupler 104*c* via the first resistor unit 104*a* (i.e., the first phase detection route).

Accordingly, the current may flow to the light emitting unit of the photocoupler 104*c* regardless of whether the relay 103 is opened or closed, such that the photocoupler 104*c* may properly detect the phase H of the AC power. In particular, even if the relay 103 is opened in the standby mode, the phase may still be detected by only a simple structure which includes the first resistor unit 104*a*, the second resistor unit

104*b* and the photocoupler 104, and may also consume less power than in the normal mode.

In the standby mode, the controller may monitor whether the AC power is supplied or not based on the phase H of the AC power. If the AC power is cut off, the controller may perform a data backup, a system reset (i.e., a central processing unit (CPU) reboot) or the like operation. However, the present general inventive concept is not limited thereto.

In the present exemplary embodiment, as the first resistor unit 104*a* is set to have a proper resistance as described above, it is possible to satisfy a constraint on power consumption requirement (e.g., 1 W). As experimental results based on the foregoing given resistances, a fusing circuit, which includes the fusing unit 101, the triac 102, the relay 103 and the phase detector 104 of FIG. 3, of the image forming apparatus 1 consumed a power of about 0.1 W or below in the standby mode. On the other hand, for reference, the fusing circuit of the image forming apparatus 1 consumed a power of about 0.53 W or more in the normal mode.

Meanwhile, the phases H of the AC power according to cases are as follows. In the present exemplary embodiment, the parallel resistance of the first and second resistors 104*a* and 104*b* in the case that the relay 103 is closed is smaller than the resistance of the first resistor unit 104*a* in the case that the relay 103 is opened, so that the intensity of the current that flows to the light emitting unit of the photocoupler 104*c* in the former case may be larger than that of the latter case. Thus, the pulse width of the phase signal H when the relay 103 is closed may be smaller than the pulse width of the phase signal H when the relay 103 is open.

Figure 4:
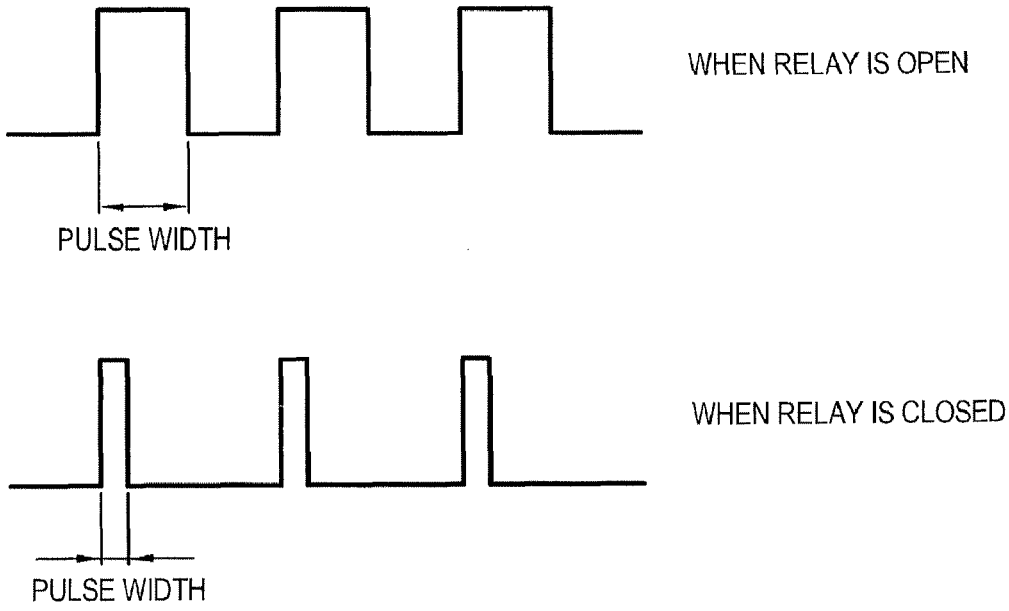
FIG. 4 illustrates a pulse width of a phase signal H in the image forming apparatus according to an exemplary embodiment of the present general inventive concept.

FIG. 4 illustrates the pulse width of the phase signal H according to the case when the relay is opened and closed. As illustrated in FIG. 4, even though the pulse width is relatively large when the relay 103 is opened, there no problem with the phase control since the triac 102 may not be precisely controlled in the standby mode. On the other hand, the pulse width when the relay 103 is closed is smaller than that of when the relay 103 is open. In the present exemplary embodiment, the image forming apparatus 1 operates normally, and thus the precise phase control is needed for the triac 102. In this exemplary embodiment, the pulse width of the phase signal H detected by the phase detector 104 is sharp enough to satisfy such a precise phase control.

As described above, the resistance of the second resistor unit 104*b* that satisfies such effect is set based on an experiment so that the pulse width of the phase signal H in the normal mode does not exceed a predetermined value required for the precise control.

Figure 5:
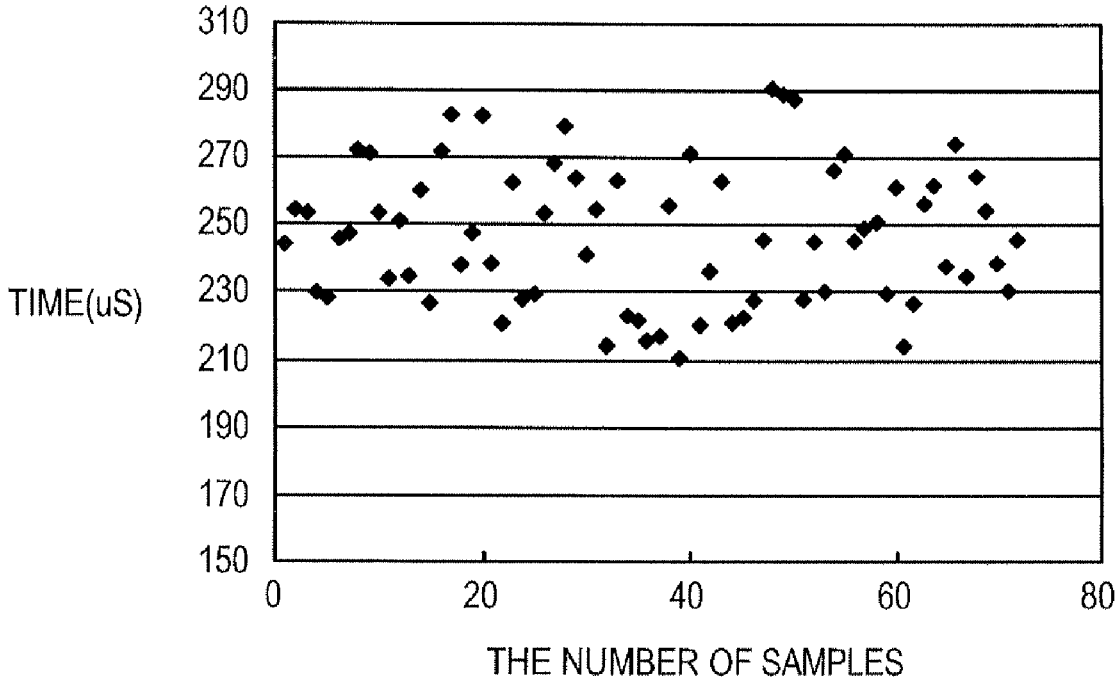
FIGS. 5 and 6 illustrate experimental examples of the pulse width of the phase signal H in the image forming apparatus according to an exemplary embodiment of the present general inventive concept.
Figure 6:
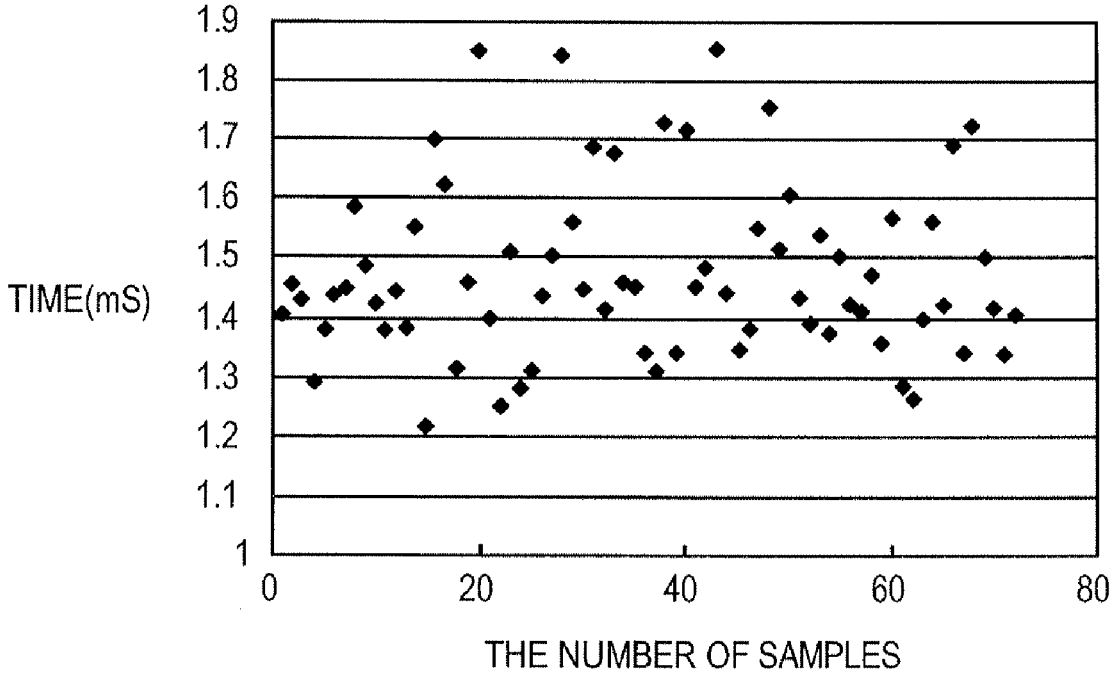

FIGS. 5 and 6 illustrate experimental examples of the pulse widths of the phase signals H when the relay 103 is closed and when the relay 103 is opened in the image forming apparatus 1 according to an exemplary embodiment of the present general inventive concept. Here, a horizontal axis indicates the number of samples used in the experiment, and a vertical axis indicates a time unit for the pulse width. Referring to FIG. 5, when the relay 103 is closed, the phase signal H has a pulse width of about 1 msec or lower at AC 220 V and 60 Hz and is thus enough to perform the precise control under such condition of the pulse width.

Figure 7:
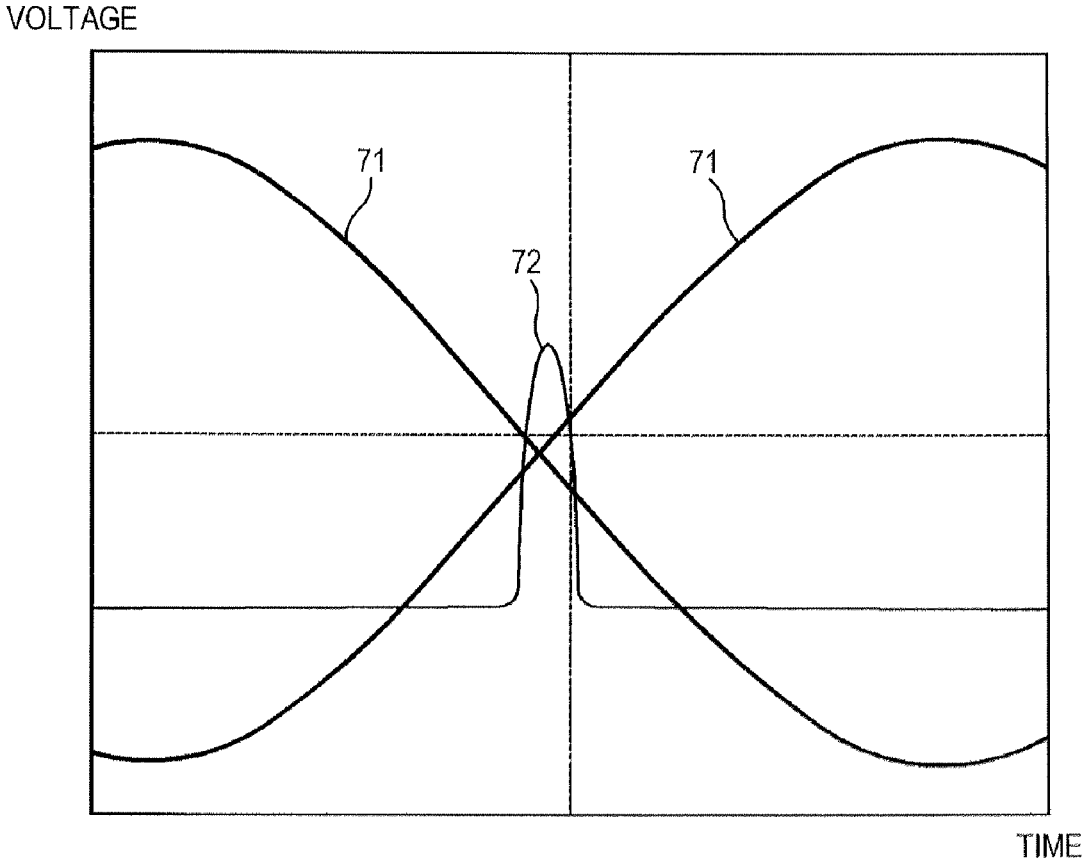
FIGS. 7 and 8 illustrate other experimental examples of the pulse width of the phase signal H in the image forming apparatus according to an exemplary embodiment of the present general inventive concept.
Figure 8:
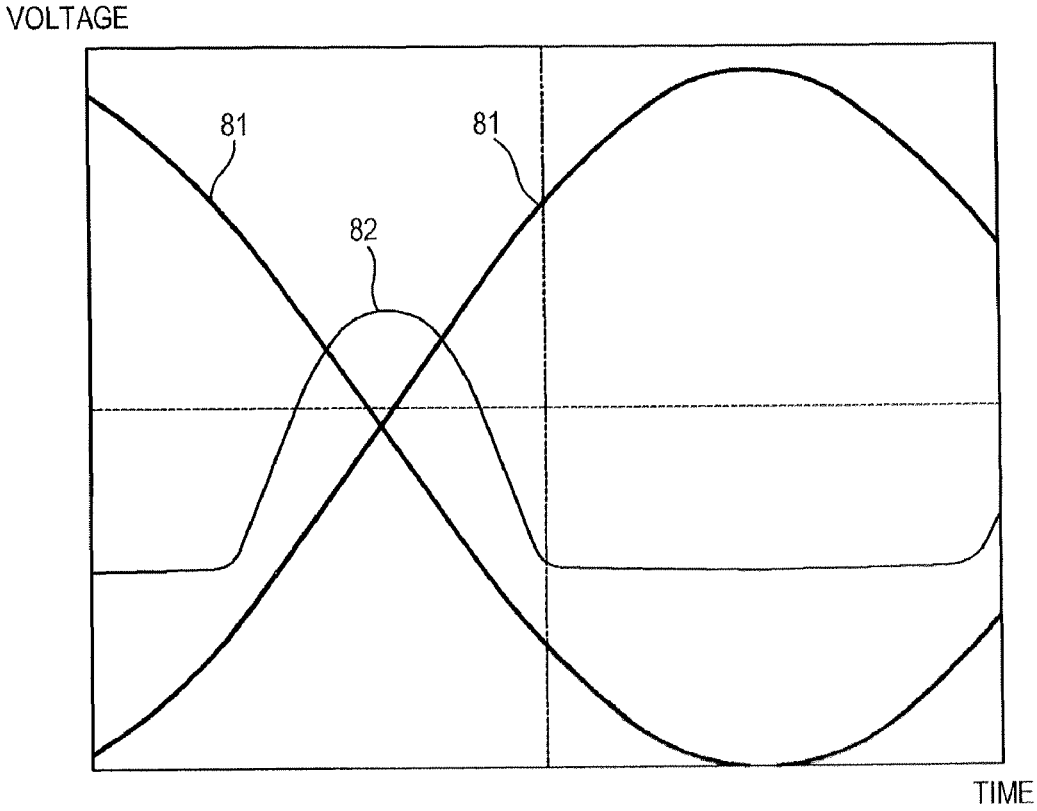

FIGS. 7 and 8 illustrate other experimental examples of the pulse width of the phase signal H in the image forming apparatus according to an exemplary embodiment of the present general inventive concept. Here, the reference numerals of "71" and "81" indicate waveforms of AC power when the relay 103 is closed and when the relay 103 is opened, respectively. Further, the reference numerals of "72" and "82" indicate waveforms of the phase signal H in the respective cases. That is, reference numerals "72" and "82" indicate waveforms of the phase signal H when the relay is closed and opened, respectively. Similar to FIGS. 5 and 6, the pulse width (see "72") of the phase signal H is so sharp when the relay 103 is closed that the pulse width is enough to perform the desired precise control.

As described above, the present general inventive concept provides an image forming apparatus capable of detecting a phase of power correctly in a standby mode and in a normal mode and satisfying a constraint on power consumption requirement, and a control method thereof.

Further, the present general inventive concept provides an image forming apparatus capable of performing precise phase control in a standby mode and even in a normal mode, and a control method thereof.

The present general inventive concept can also be embodied as computer-readable codes on a computer-readable medium. The computer-readable medium can include a computer-readable recording medium and a computer-readable transmission medium. The computer-readable recording medium is any data storage device that can store data which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium may also be distributed over network coupled computer systems so that the computer-readable code is stored and executed in a distributed fashion. The computer-readable transmission medium may transmit carrier waves or signals (e.g., wired or wireless data transmission through the Internet). Also, functional programs, codes, and code segments to accomplish the present general inventive concept may be easily construed by programmers skilled in the art to which the present general inventive concept pertains.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus having a normal mode and a standby mode, comprising:

an image forming unit to form an image;

a switching unit which selectively allows a power to be supplied to the image forming unit;

a controller to control the switching unit based on a phase signal of the power;

a power cut-off unit to cut off the power to the image forming unit in the standby mode; and a phase detector which is connected to both ends of the power cut-off unit, to detect a phase of the power via different phase detection routes according to whether being in the normal mode or in the standby mode, and to output the phase signal of the power so that a power consumption of the image forming apparatus does not exceed a predetermined value in the standby mode.

2. The image forming apparatus of claim 1, wherein the phase detector comprises:

a first resistor unit connected to a first end of the power cut-off unit to form a first phase detection route in the standby mode;

a second resistor unit connected to an end opposite to first end of the power cut-off unit as connected in parallel with the first resistor unit to form a second phase detection route in the normal mode; and a current-phase converter to output the phase signal of the power corresponding to a current of one of the first phase detection route and the second phase detection route.

3. The image forming apparatus of claim 2, wherein a resistance of the first resistor unit is set so that the image forming apparatus consumes a power of about 1 W or less in the standby mode.

4. The image forming apparatus of claim 2, wherein a parallel resistance of the first and second resistor units is set so that the phase signal of the power has a pulse width of about 1 msec or less in the normal mode.

5. The image forming apparatus of claim 2, wherein the current-phase converter comprises a photocoupler, and the photocoupler comprises a light emitting unit connected in series with the first and second resistor units and a light receiving unit to output the phase signal of the power based on light emitted from the light emitting unit.

6. The image forming apparatus of claim 1, wherein the controller monitors whether the power is supplied or not based on the phase signal of the power in the standby mode.

7. The image forming apparatus of claim 6, wherein the controller performs at least one operation between a data backup and a system reset if the power is cut off.

8. An image forming apparatus having a normal mode and a standby mode, comprising:

an image forming unit to form an image;

a switching unit to selectively supply power to the image forming unit;

a controller to control the switching unit based on a phase signal of the power;

a power cut-off unit to cut off the power to the image forming unit in the standby mode; and a phase detector to detect a phase of the power and outputs a phase signal of the power so that a pulse width of the phase signal is not larger than a first reference value in the normal mode and a power consumption of the image forming apparatus does not exceed a second reference value in the standby mode.

9. The image forming apparatus of claim 8, wherein the phase detector comprises:

a first resistor unit connected to a first end of the power cut-off unit;

a second resistor unit connected to an end opposite to the first end of the power cut-off unit as connected in parallel with the first resistor unit; and a current-phase converter to output the phase signal of the power, which has a pulse width corresponding to an intensity of a current flowing in the first and second resistor units, to the controller.

10. The image forming apparatus of claim 9, wherein a resistance of the first resistor unit is set so that the second reference value is about 1 W in the standby mode.

11. The image forming apparatus of claim 9, wherein a parallel resistance of the first and second resistor units is set so that the first reference value is about 1 msec in the normal mode.

12. The image forming apparatus of claim 9, wherein the current-phase converter comprises a photocoupler, and the photocoupler comprises a light emitting unit connected in series with the first and second resistor units, and a light receiving unit to output the phase signal of the power based on light emitted from the light emitting unit.

13. The image forming apparatus of claim 8, wherein the controller monitors whether the power is supplied or not based on the phase signal of the power in the standby mode.

14. The image forming apparatus of claim 13, wherein the controller performs at least one operation between a data backup and a system reset if the power is cut off.

15. A method of controlling an image forming apparatus having a normal mode and a standby mode, comprising:

outputting a pulse signal of a power by detecting a phase of the power supplied to the image forming apparatus so that a pulse width of a phase signal is not larger than a first reference value in the normal mode and a power consumption of the image forming apparatus does not exceed a second reference value in the standby mode;

supplying the power by performing a switching operation based on the phase signal of the power in the normal mode; and cutting off the power by stopping the switching operation in the standby mode.

16. The method of claim 15, wherein the outputting the phase signal of the power comprises detecting the phase of the power via different phase detection routes according to whether being in the normal mode or in the standby mode.

17. The method of claim 15, wherein the first reference value is about 1 msec.

18. The method of claim 15, wherein the second reference value is about 1 W.

19. The method of claim 15, further comprising:

monitoring whether the power is supplied or not based on the phase signal of the power in the standby mode.

20. The method according to claim 19, further comprising:

performing at least one operation between a data backup and a system reset if the power is cut off.

21. An image forming apparatus comprising:

a controller to detect a phase signal of a main power supplied from a power supply and to control a first and second power, which respectively correspond to a first and second mode of the image forming apparatus, supplied to the image forming apparatus based on the phase signal of the main power, the controller detects the phase signal of the main power through a first path during the first mode and a second path during the second mode.

22. The image forming apparatus of claim 21, further comprising:

a cut-off unit disposed between the power supply and an image forming unit.

23. The image forming apparatus of claim 21, wherein the first path is defined from a point between the power supply and the cut-off unit to the controller.

24. The image forming apparatus of claim 21, wherein the second path is defined from a point between the cut-off unit and the image forming unit to the controller.

25. The image forming apparatus of claim 21, wherein the first mode is a standby mode and the second mode is a normal mode.

26. The image forming apparatus of claim 25, wherein the first power is less than the second power.

27. An image forming apparatus comprising:

an image forming unit;

a power source;

a relay disposed between the power source and the image forming unit; and a phase detector having two terminals coupled to opposite ends of the relay and another terminal coupled between the power source and the image forming unit to detect a phase to control supply of power of the power source to the image forming unit.

28. An image forming apparatus having a normal mode and a standby mode, comprising:

a phase detector to output a pulse signal of a power by detecting a phase of the power received from an external device so that a pulse width of the phase signal is not larger than a first reference value in the normal mode and a power consumption of the image forming apparatus does not exceed a second reference value in the standby mode;

a switching unit to supply the power by performing a switching operation based on the phase signal of the power in the normal mode; and a power cut-off unit to cut off the power by stopping the switching operation in the standby mode.

29. The image forming apparatus of claim 1, wherein the switching unit performs a switching operation on alternating current (AC) power supplied to a fusing unit of the image forming unit so as to control a temperature of the fusing unit.

30. The image forming apparatus of claim 29, wherein the phase detector is configured such that performing phase detection in the standby mode consumes less power than performing phase detection in the normal mode.

31. The image forming apparatus of claim 30, wherein the phase detector is configured to output pulse signals relating to the detected phase of alternating current (AC) power such that a pulse width of pulse signals output during the standby mode is greater than a pulse width of pulse signals output during the normal mode.

32. The image forming apparatus of claim 31, wherein, during the standby mode, pulse signals output by the phase detector are used by the image forming apparatus to determine presence of AC power, and during the normal mode, pulse signals output by the phase detector are used by the controller to control the switching unit.

33. The image forming apparatus of claim 31, wherein the switching unit comprises a triac, and the power cut-off unit comprises a relay.

34. The image forming apparatus of claim 2, wherein the first resistor unit has a resistance value that is higher than a resistance value of the second resistor unit.

35. The image forming apparatus of claim 8, wherein the switching unit performs a switching operation on alternating current (AC) power supplied to a fusing unit of the image forming unit so as to control a temperature of the fusing unit.

36. The image forming apparatus of claim 35, wherein the phase detector is configured such that performing phase detection in the standby mode consumes less power than performing phase detection in the normal mode.

37. The image forming apparatus of claim 36, wherein the phase detector is configured to output pulse signals relating to the detected phase of alternating current (AC) power such that a pulse width of pulse signals output during the standby mode is greater than a pulse width of pulse signals output during the normal mode.

38. The image forming apparatus of claim 37, wherein, during the standby mode, pulse signals output by the phase detector are used by the image forming apparatus to determine presence of AC power, and during the normal mode, pulse signals output by the phase detector are used by the controller to control the switching unit.

39. The image forming apparatus of claim 9, wherein the first resistor unit has a resistance value that is higher than a resistance value of the second resistor unit.

* * * * *